US008882526B2

(12) United States Patent
Li et al.

(10) Patent No.: US 8,882,526 B2
(45) Date of Patent: Nov. 11, 2014

(54) ELECTRICAL CONNECTOR WITH CONNECTING MEMBER FOR IMPROVING ASSEMBLING EFFICIENCY

(71) Applicant: Luxshare Precision Industry Co., Ltd., Shenzhen (CN)

(72) Inventors: Bin Li, Kunshan (CN); Yun Feng, Kunshan (CN); Tao Wang, Kunshan (CN)

(73) Assignee: Luxshare Precision Industry Co., Lt.d, Shenzhen, Guangong Province (CN)

( * ) Notice: Subject to any disclaimer, the term of this patent is extended or adjusted under 35 U.S.C. 154(b) by 71 days.

(21) Appl. No.: 13/787,790

(22) Filed: Mar. 6, 2013

(65) Prior Publication Data

US 2013/0237080 A1 Sep. 12, 2013

(30) Foreign Application Priority Data

Mar. 8, 2012 (CN) ..... 2012 2 0084007 U

(51) Int. Cl.

| | |
|---|---|
| ***H01R 13/625*** | (2006.01) |
| ***H01R 4/50*** | (2006.01) |
| ***H01R 13/62*** | (2006.01) |
| ***H01R 12/50*** | (2011.01) |
| ***H01R 13/504*** | (2006.01) |
| *H01R 107/00* | (2006.01) |
| *H01R 24/62* | (2011.01) |

(52) U.S. Cl.

CPC ..... *H01R 23/70* (2013.01); *H01R 2107/00* (2013.01); *H01R 13/62* (2013.01); *H01R 24/62* (2013.01); *H01R 13/5045* (2013.01)

USPC ..... 439/345; 439/660

(58) Field of Classification Search

CPC .... H01R 23/70; H01R 13/62; H01R 13/5045; H01R 24/62; H01R 2107/00; H01R 23/6873

USPC ..... 439/345, 660, 607.1, 620.15, 620.19, 439/620.22

See application file for complete search history.

(56) References Cited

U.S. PATENT DOCUMENTS 5,975,954 A * 11/1999 Wu et al. ..... 439/607.35

* cited by examiner

*Primary Examiner* — Javaid Nasri

(74) *Attorney, Agent, or Firm* — Cheng-Ju Chiang

(57) ABSTRACT

An electrical connector compatible to USB 3.0 standard includes an insulative housing, a number of contacts, a fixing member and a connecting member. The insulative housing includes a mating portion and a receiving slot. Each contact includes a tail section and a resilient arm. The connecting member is received in the receiving slot of the insulative housing. The connecting member includes a number of first pads and a number of second pads electrically connecting with the first pads. With the arrangement of the connecting member, the first pads for constituting the USB 3.0 contact group are needless of being directly insert-molded with the insulative housing as a result that the assembling efficiency of the electrical connector can be improved.

20 Claims, 11 Drawing Sheets

ELECTRICAL CONNECTOR WITH CONNECTING MEMBER FOR IMPROVING ASSEMBLING EFFICIENCY

BACKGROUND OF THE INVENTION

1. Field of the Invention

The present invention relates to an electrical connector, and more particularly, to an electrical connector compatible to USB 3.0 standard and having a connecting member for improving assembling efficiency thereof.

2. Description of Related Art

On November 2008, a new generation of USB 3.0 (super high-speed USB) enacted by industry-leading corporations including Intel, Microsoft, HP, TI, NEC and ST-NXP etc. was released. The USB 3.0 standard provides transmission speed 10 times quicker than the USB 2.0 standard and has higher energy efficiency so that the USB 3.0 standard can be applied in PC peripheral devices and consumer electronics.

The development of the USB (Universal Serial Bus) standards is as follows: the first version, known as USB 1.0, was released on 1996 and its transmission speed is only up to 1.5 Mb/s; two years later, the USB 1.0 was upgraded to USB 1.1 with its transmission speed to 12 Mb/s; on April 2000, current widely used USB 2.0 was released with its transmission speed up to 480 Mb/s; however, the speed of USB 2.0 cannot meet the requirements of actual use anymore and under this condition, the USB 3.0 was pushed forward and the maximum transmission speed thereof is up to 5.0 Gb/s.

The USB 3.0 standard (or specification) defines type-A receptacle and plug and the type-A USB 3.0 plug is compatible to USB 2.0 receptacle. Comparing with the preceding generation of type-A USB 2.0 plug, the type-A USB 3.0 plug newly adds five elastic contacts and totally has nine contacts. The newly added five contacts include two pairs of high-speed differential signal contacts and a grounding contact therebetween. The afore-mentioned nine contacts extend to a rear end of an insulative housing for being soldered, either directly or indirectly, to cables or circuit board. Normally, the newly added five contacts are insert-molded with the insulative housing for fixation. However, since such insert-molding process is usually complex, how to set the newly added five contacts to the insulative housing needs to be improved.

Hence, an electrical connector with a connecting member for improving assembling efficiency of the electrical connector is desired.

BRIEF SUMMARY OF THE INVENTION

The present invention provides an electrical connector compatible to USB 3.0 standard. The electrical connector includes an insulative housing, a plurality of contacts, a fixing member reliably retaining and organizing the contacts and a connecting member. The insulative housing includes a mating portion for mating with a complementary connector and a receiving slot at least partly extending to the mating portion. Each contact includes a tail section and a resilient arm. The resilient arm extends onto the mating portion and includes a contacting section for mating with the complementary connector. The fixing member is fixed to the insulative housing. The connecting member is received in the receiving slot of the insulative housing. The connecting member includes a plurality of first pads and a plurality of second pads electrically connecting with the first pads. The contacting sections and the first pads are arranged on the mating portion and are located at two different rows along an extending direction of the mating portion. The contacting sections extend beyond the first pads along a thickness direction of the mating portion perpendicular to the extending direction. With arrangement of the connecting member, the first pads for constituting the USB 3.0 contact group are needless of being directly insert-molded with the insulative housing. Instead, through assembling the connecting member to the insulative housing can likewise meet the requirement of constituting the USB 3.0 contact group, and importantly, it is much easier to assemble the connecting member to the insulative housing than insert-molding the first pads with the insulative housing. As a result, the assembling efficiency of the electrical connector according to the present invention can be greatly improved and the cost of the electrical connector can be decreased accordingly.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENTS

Figure 1:
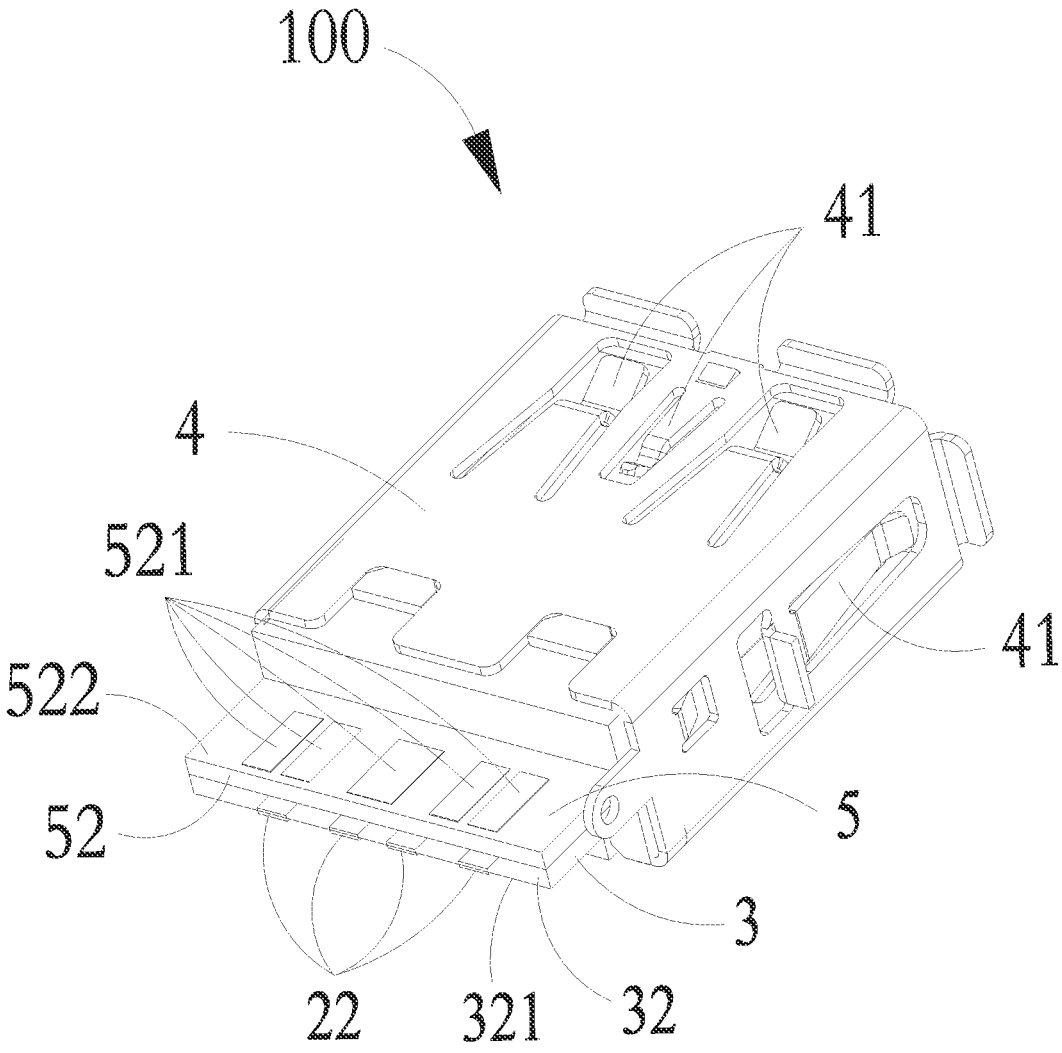
FIG. 1 is a perspective view of an electrical connector in accordance with a first illustrated embodiment of the present invention.

Reference will now be made to the drawing figures to describe the embodiments of the present invention in detail. In the following description, the same drawing reference numerals are used for the same elements in different drawings.

Referring to FIGS. 1 to 4, the present invention discloses an electrical connector 100 compatible to type-A USB 3.0 standard. According to the illustrated embodiment of the present invention, the electrical connector 100 is either a receptacle connector or a plug connector applied to USB 3.0 cable assembles or mounted to a circuit board. The electrical connector 100 includes an insulative housing 1, a plurality of contacts 2, a fixing member 3 for reliably retaining and organizing the contacts 2, a connecting member 5 assembled to the insulative housing 1, and a metal shell 4 enclosing the insulative housing 1 and the fixing member 3.

Figure 2:
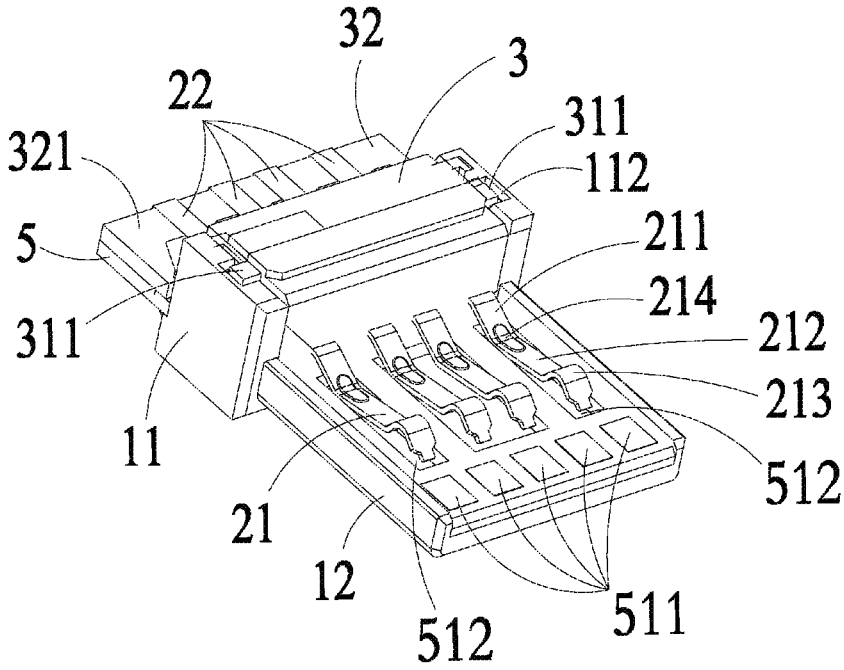
FIG. 2 is a partly perspective view of the electrical connector as shown in FIG. 1 while taken from a different aspect.
Figure 4:
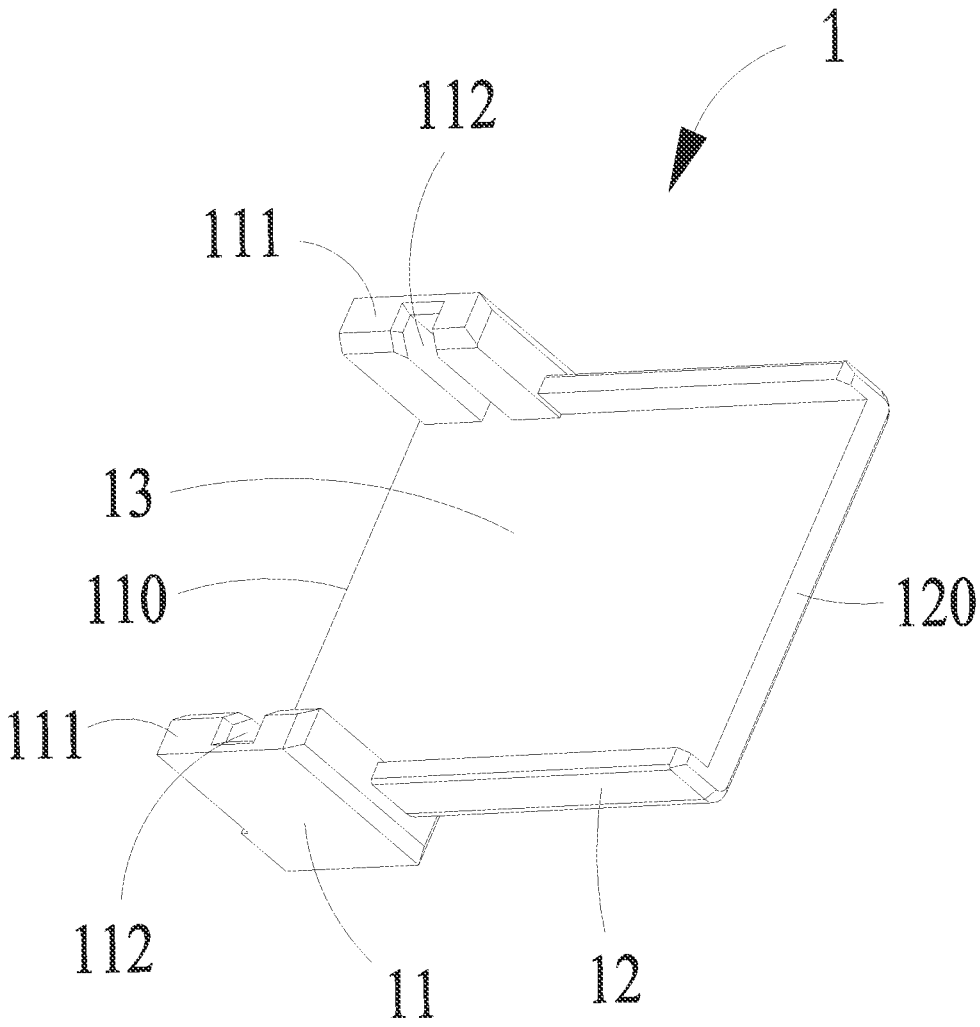
FIG. 4 is a perspective view of an insulative housing of the electrical connector as shown in FIG. 1.
Figure 9:
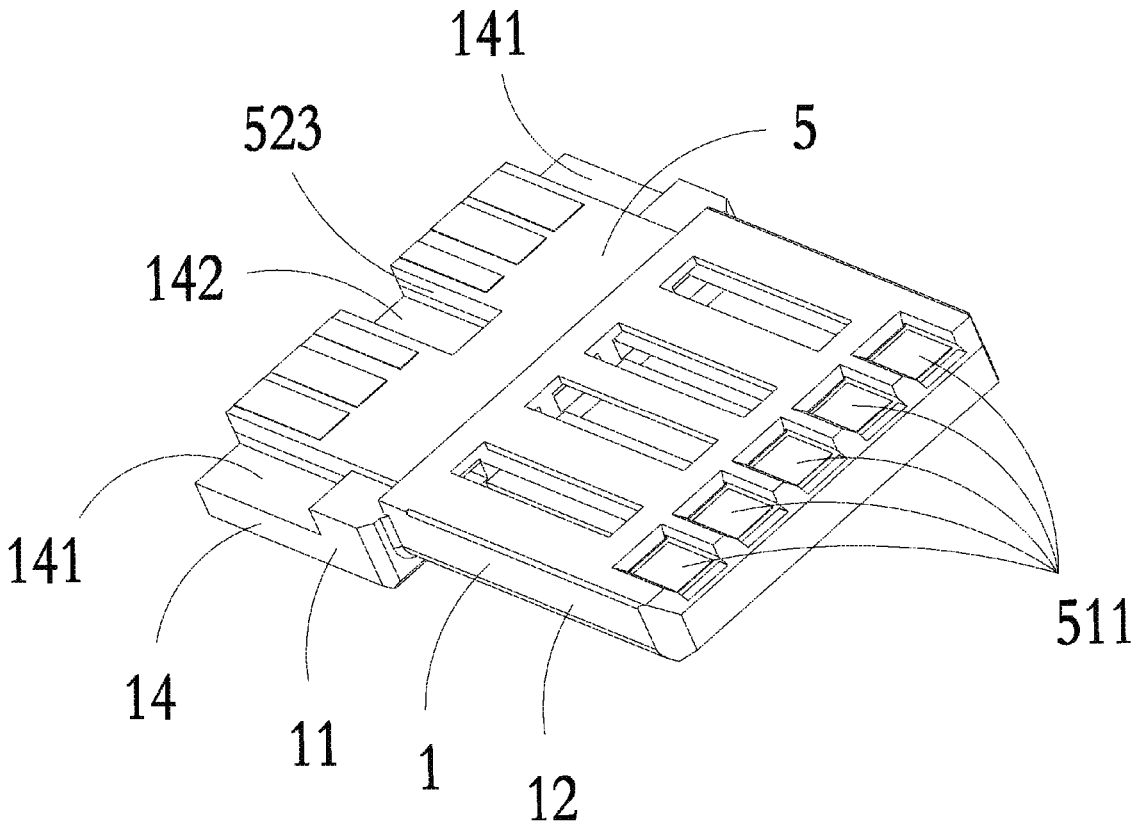
FIG. 9 is a partly assembled view of the electrical connector of FIG. 7 with the connecting member mating with the insulative housing.
Figure 10:
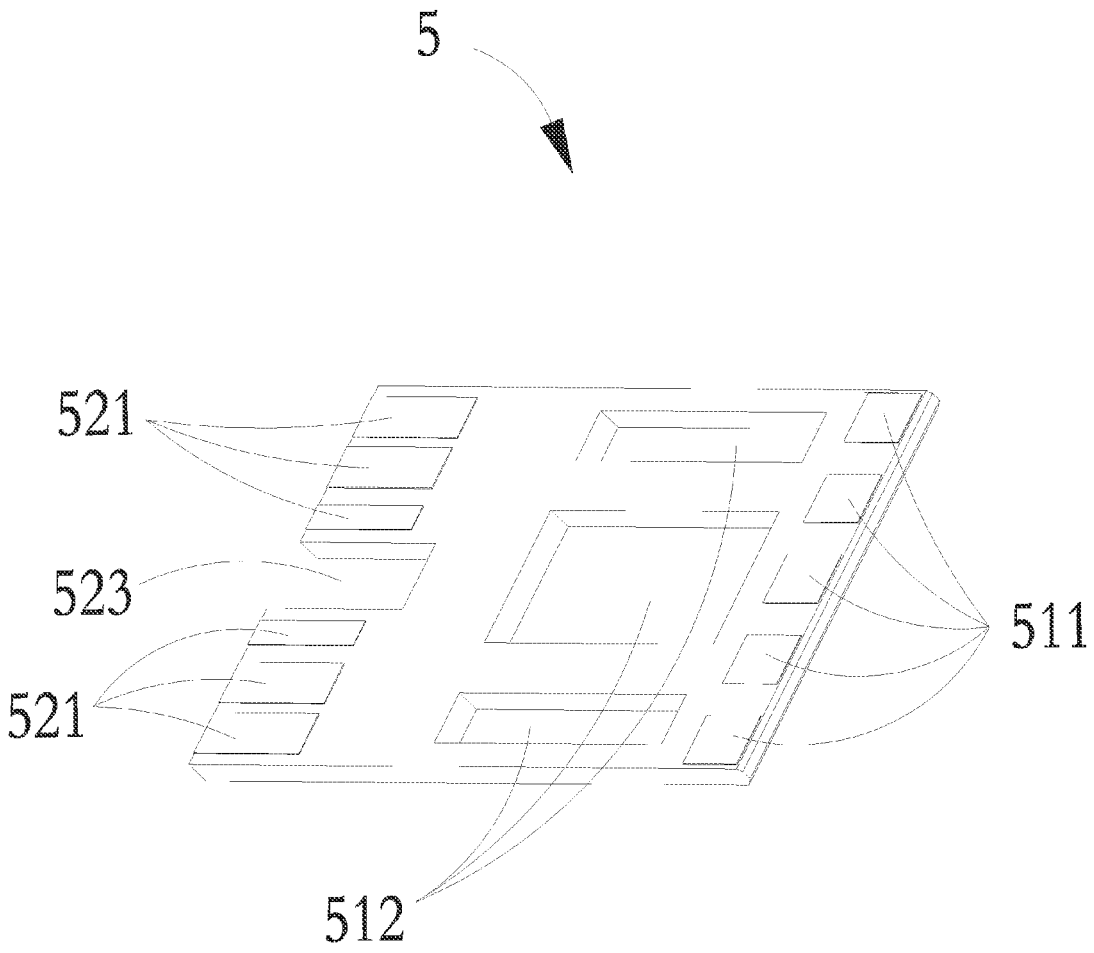
FIG. 10 is a perspective view of the connecting member as shown in FIG. 9.

Referring to FIGS. 2 and 4, the insulative housing 1 includes a base portion 11 and a mating portion 12 extending forwardly from the base portion 11. The base potion 11 and the mating portion 12 define a rear end surface 110 and a front end surface 120, respectively. As shown in FIG. 4, the insulative housing 1 further defines a receiving slot 13 extending through the front end surface 120 and the rear end surface 110 for receiving and positioning the connecting member 5. According to the first illustrated embodiment of the present invention, the receiving slot 13 is U-shaped. However, in other embodiments, i.e. as shown in FIGS. 9-10, the receiving slot 13 can be surrounded by four peripheral walls so as to be of a flat-tube shape. Referring to FIG. 4, the base portion 11 includes a pair of vertical walls 111 and a pair of slits 112 formed on corresponding inner sides of the vertical walls 111. The slits 112 extend along a vertical direction and are in communication with the receiving slot 13.

Referring to FIGS. 1, 2 and 5 to 8, the contacts 2 are compatible to USB 2.0 standard. Each contact 2 includes a resilient arm 21, a tail section 22 opposite to the resilient arm 21 and a middle section 23 (see FIG. 8) connecting the resilient arm 21 and the tail section 22. As shown in FIG. 2, the resilient arms 21 extend onto the mating portion 12 and are deformable along the vertical direction when the electrical connector 100 mates with a complementary connector (not shown). The tail sections 22 are exposed to the exterior for either connecting to cables or to a circuit board. The middle sections 23 are retained in the fixing member 3 so that the contacts 2 can be unitarily combined with the fixing member 3. According to the illustrated embodiment of the present invention, the middle sections 23 of the contacts 2 are embedded in the fixing member 3 through insert-molding technology. Understandably, the middle sections 23 can also be assembled to the fixing member for fixation. As a result, the contacts 2 and the fixing member 3 jointly form a so-called contact module to those of ordinary skill in the art.

Referring to FIG. 2, in detail, each resilient arm 21 includes an inclined section 211 downwardly extending beyond the fixing member 3, a connecting section 212 extending forwardly from the inclined section 211 and a curved contacting section 213 extending upwardly from the connecting section 212. Besides, in order to reinforce the strength of certain position, each resilient arm 21 includes a stamped trace 214 at the joint of the inclined section 211 and the connecting section 212. With the resilient arms 21 designed in such configuration, the resilient arms 21 are capable of balanced elasticity and rigidity.

Figure 5:
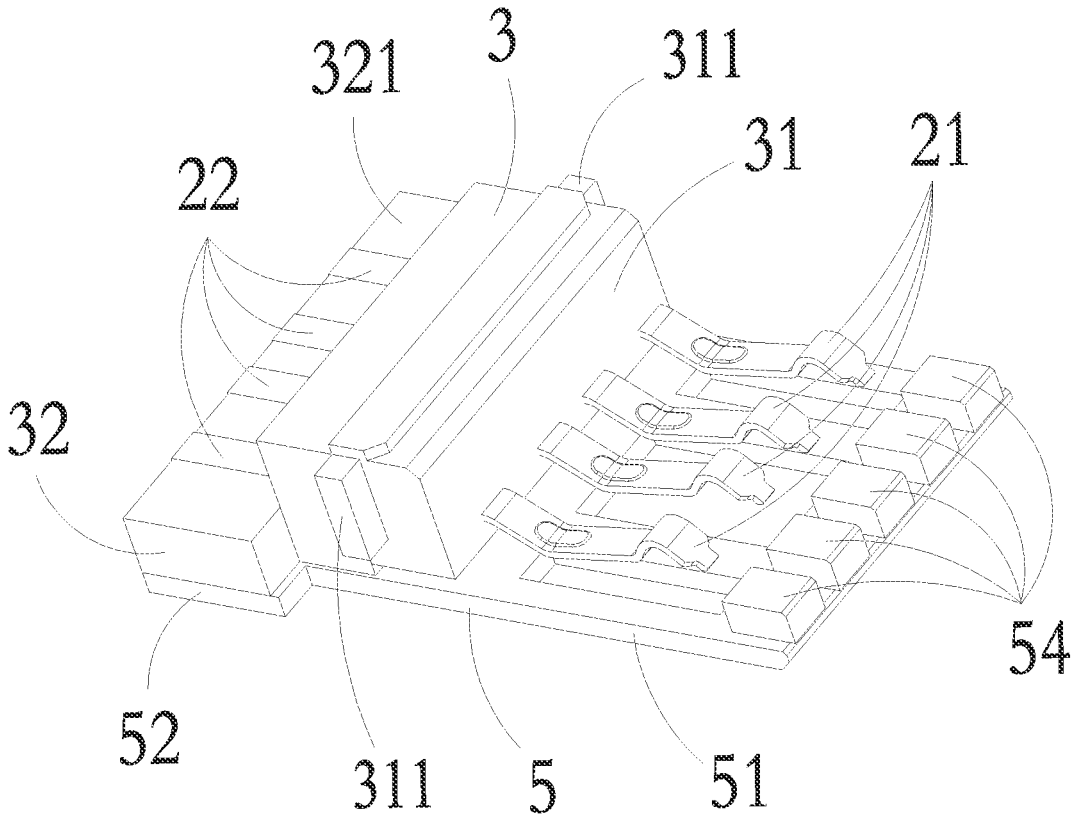
FIG. 5 is a partly assembled view of another electrical connector in accordance with a second illustrated embodiment of the present invention.

Referring to FIGS. 1, 2 and 5, according to the illustrated embodiment of the present invention, the fixing member 3 is insulative and includes a rectangular body portion 31 and a first flat platform 32 extending backwardly from the body portion 31. The body portion 31 includes a pair of protrusions 311 inserted in the slits 112 along a top-to-bottom direction so that the fixing member 3 is fixed to the insulative housing 1. The first flat platform 32 is thinner than the body portion 31 and defines a first mounting surface 321. As shown in FIG. 2, the tail sections 22 of the contacts 2 are exposed on the first mounting surface 321 so as to be easily soldered to cables or other components. Besides, the fixing member 3 presses against the connecting member 5 along the vertical direction for position restriction.

As shown in FIG. 1, the metal shell 4 includes a plurality of engaging arms 41 extending towards the mating portion 12 for abutting against the complementary connector.

Figure 3:
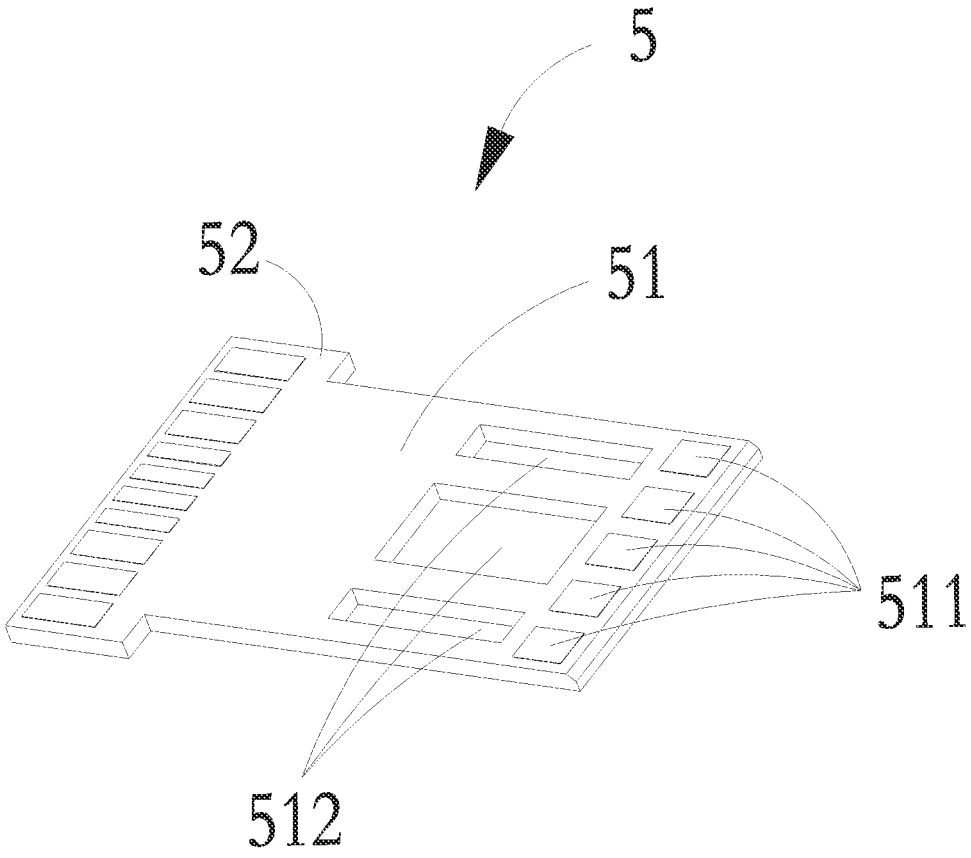
FIG. 3 is a perspective view of a connecting member of FIG. 2.
Figure 6:
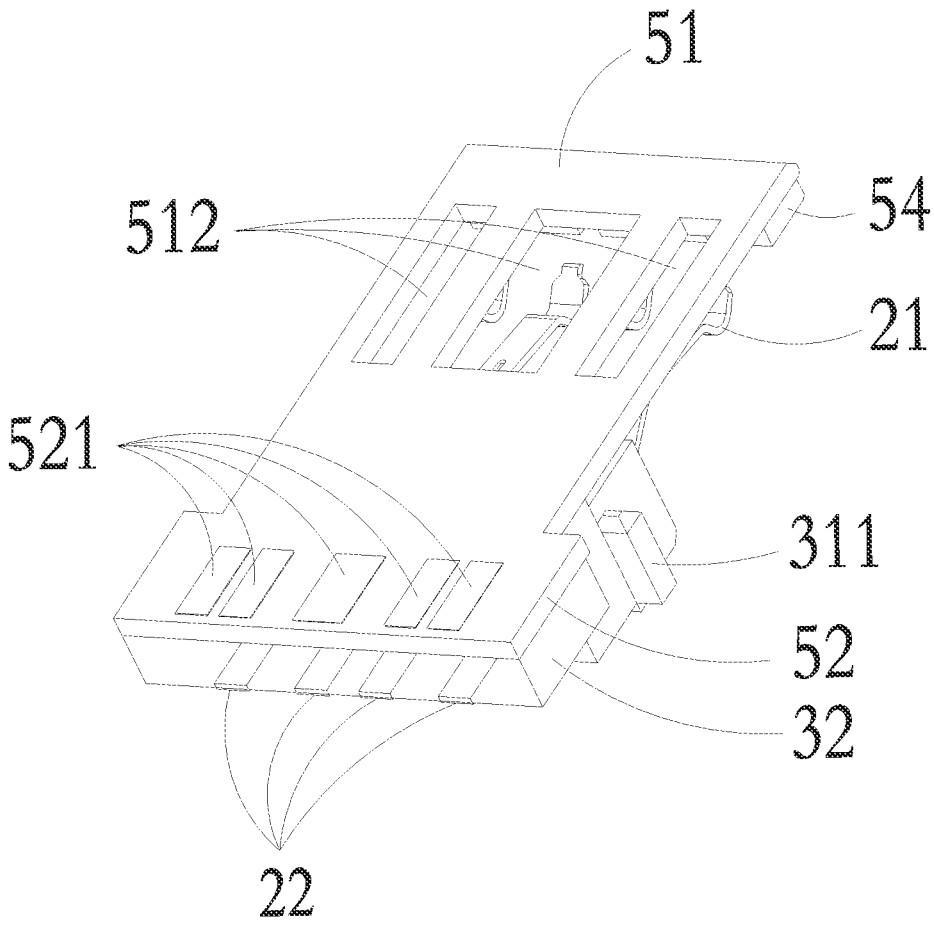
FIG. 6 is another view of the electrical connector shown in FIG. 5.

Referring to FIGS. 1 to 3, the connecting member 5 is T-shaped and includes a front insertion portion 51 and a second flat platform 52 extending backwardly from the insertion portion 51. When the connecting member 5 is inserted into the receiving slot 13 in place along a rear-to-front direction, the second flat platform 52 is ultimately stopped by the base portion 11 of the insulative housing 1 to avoid over-insertion. The insertion portion 51 includes a plurality of first pads 511 arranged in a single row. The first pads 511 include two pairs of high-speed differential signal contacts and a grounding contact therebetween. Besides, the insertion portion 51 defines a plurality of depressions 512 behind the first pads 511. The depressions 512 should be broadly interpreted and certainly include through holes as shown in FIG. 6. Referring to FIG. 2, the depressions 512 are located under corresponding resilient arms 21 so that reasonable space for the deformation of the resilient arms 21 can be provided when the electrical connector 100 mates with the complementary connector. Referring to FIG. 1, the second flat platform 52 includes a plurality of second pads 521 electrically connecting with the first pads 511. Besides, the second flat platform 52 includes a second mounting surface 522 with the second pads 521 exposed thereon. The connecting member 5 is a printed circuit board, or a flexible circuit board, or any insulative board electroplated with metal connecting traces connecting the first pads 511 and the second pads 521. The first flat platform 32 and the second flat platform 52 are cooperated with each other to jointly form a soldering platform for soldering the tail sections 22 and the second pads 521 to the cables or other components.

As shown in FIG. 1, according to the first embodiment of the present invention, the first flat platform 32 and the second flat platform 52 are stacked with each other and both extend backwardly beyond a rear end of the electrical connector 100. The first mounting surface 321 and the second mounting surface 522 are opposite to each other. The contacts 2 do not contact the connecting member 5. Referring to FIG. 2, the tail sections 22 and the second pads 521 are arranged in upper and lower rows of the fixing member 3 and the connecting member 5, respectively. As a result, it is easy to solder the tail sections 22 and the second pads 521 to the cables. Besides, the contacting sections 213 extend beyond the first pads 511 along a thickness direction of the mating portion 12. The contacting sections 213 and the first pads 511 are arranged on the mating portion 12 and are located at two different rows along an extending direction of the mating portion 12. Since the contacting sections 213 and the first pads 511 are compatible to USB 3.0 type-A standard, detailed description thereof is omitted herein.

Referring to FIG. 5, according to a second embodiment of the present invention, each first pad 511 is soldered and covered by a rectangular metal block 54 for better contacting with corresponding contacts of the complementary connector.

Figure 7:
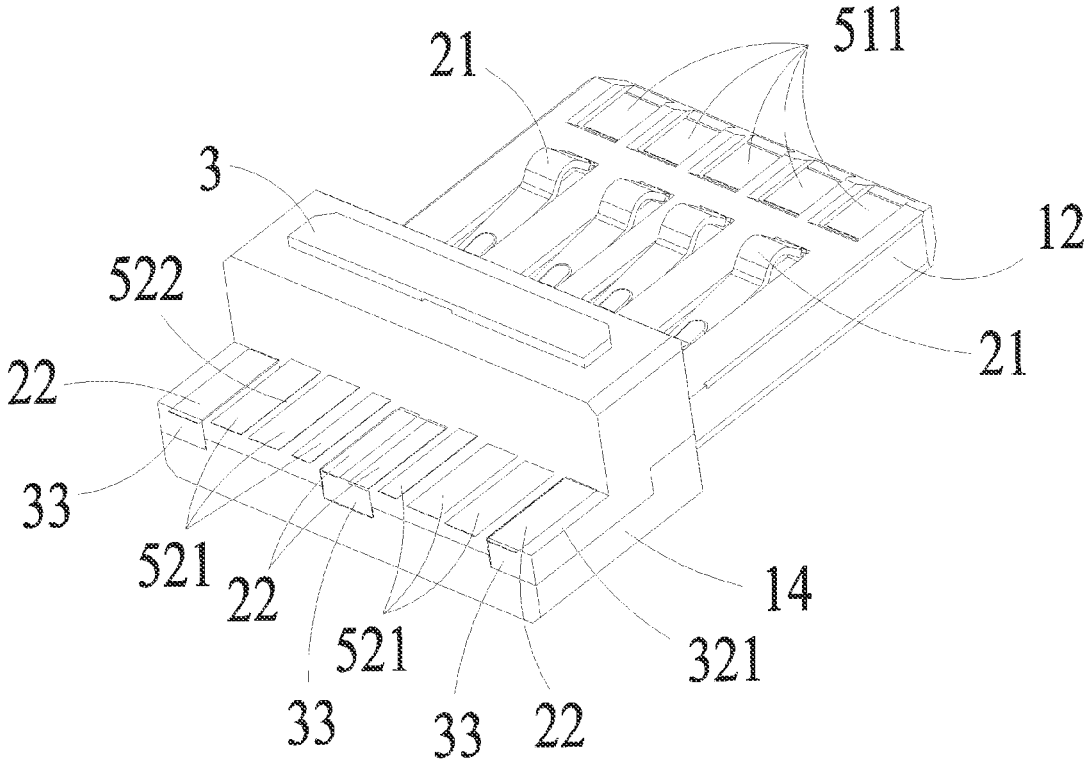
FIG. 7 is a partly assembled view of another electrical connector in accordance with a third illustrated embodiment of the present invention.
Figure 8:
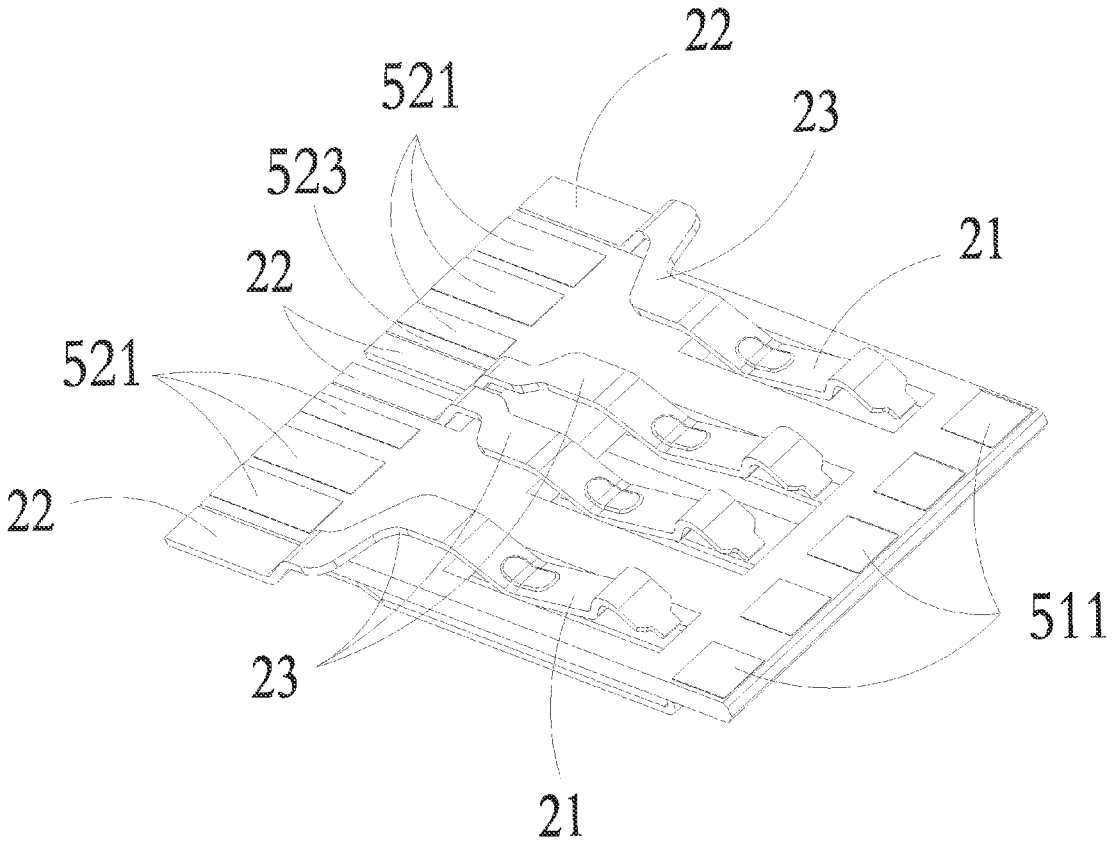
FIG. 8 is an exploded view of the electrical connector of FIG. 7, showing relationships of the contacts and the connecting member.

Referring to FIGS. 7 and 8, according to a third embodiment of the present invention, the tail sections 22 and the second pads 521 are arranged in a single row and are coplanar with each other. Under this arrangement, the tail sections 22 and the second pads 521 of the electrical connector 100 can be soldered to cables with high efficiency. In detail, the insulative housing 1 further includes a third flat platform 14 extending opposite to the mating portion 12 to upwardly support the first flat platform 32 and the second flat platform 52. As shown in FIG. 7, the first flat platform 32 and the second flat platform 52 are interweaved with each other so as to form the single row. According to the third embodiment of the present invention, the first flat platform 32 includes three separated blocks 33 on which the tail sections 22 are mounted and exposed. The insulative housing 1 includes a pair of notches 141 to position the lateral two separated blocks 33 so that the second flat platform 52 can be restricted therebetween. Besides, each of the second flat platform 52 and the third flat platform 14 defines a position slot 523, 142 in alignment with each other along a vertical direction. Referring to FIG. 7, the middle separated block 33 is jointly received in the position slots 523, 142. Referring to FIGS. 8 and 10, the middle two tail sections 22 of the contacts 2 are received in the position slot 523 of the second flat platform 52 of the connecting member 5.

Figure 11:
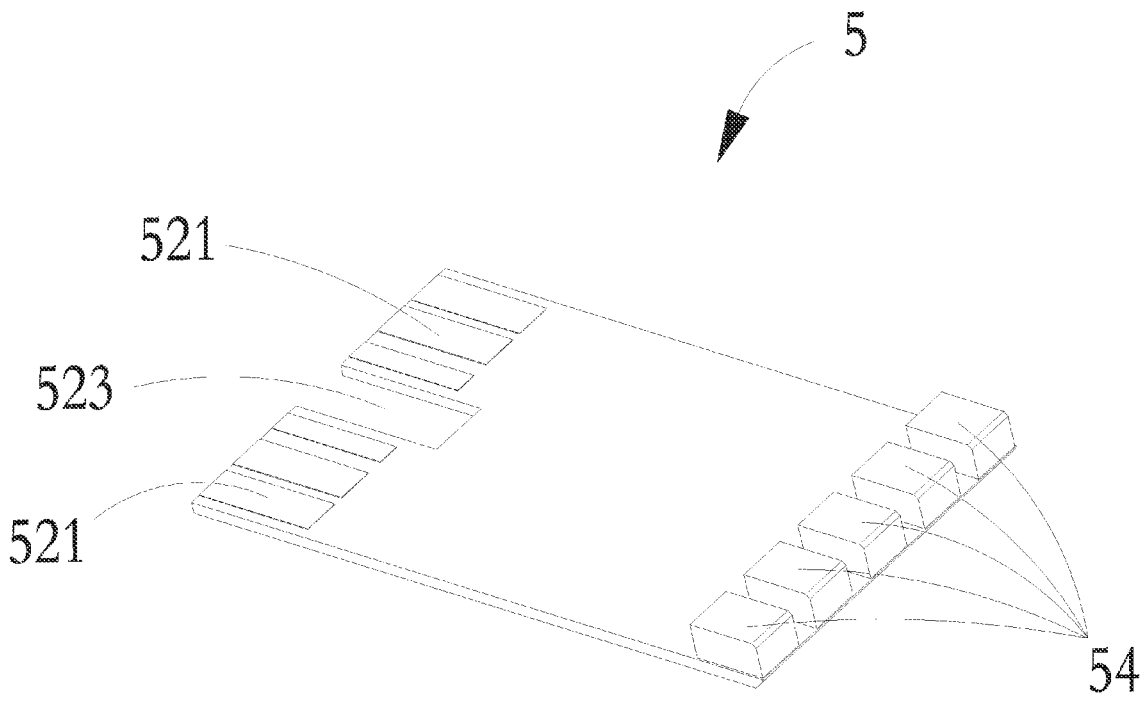
FIG. 11 is a perspective view of another connecting member similar to that of FIG. 10, in accordance with a fourth illustrated embodiment of the present invention.

Referring to FIG. 11, similar to FIG. 5, according to a fourth embodiment of the present invention, each first pad 511 is soldered and covered by a rectangular metal block 54 for better contacting with corresponding contacts of the complementary connector.

With arrangement of the connecting member 5 which is provided with the first pads 511, the first pads 511 for constituting the USB 3.0 contact group are needless of being directly insert-molded with the insulative housing 1. Instead, through assembling the connecting member 5 to the insulative housing 1 can likewise meet the requirement of constituting the USB 3.0 contact group, and importantly, it is much easier to assemble the connecting member 5 to the insulative housing 1 than insert-molding the first pads 511 with the insulative housing 1. As a result, the assembling efficiency of the electrical connector 100 according to the present invention can be greatly improved and the cost of the electrical connector 100 can be decreased accordingly.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector compatible to Universal Serial Bus (USB) 3.0 standard, comprising:

an insulative housing comprising a mating portion for mating with a complementary connector and a receiving slot at least partly extending to the mating portion;

a plurality of contacts each comprising a tail section and a resilient arm, each resilient arm extending onto the mating portion and comprising a contacting section for mating with the complementary connector;

a fixing member reliably retaining and organizing the contacts, the fixing member being fixed to the insulative housing; and a connecting member received in the receiving slot of the insulative housing, the connecting member comprising a plurality of first pads and a plurality of second pads electrically connecting with the first pads, the contacting sections and the first pads being arranged on the mating portion and being located at two different rows along an extending direction of the mating portion, the contacting sections extending beyond the first pads along a thickness direction of the mating portion perpendicular to the extending direction.

2. The electrical connector as claimed in claim 1, wherein the connecting member is a printed circuit board, or a flexible circuit board, or any insulative board electroplated with metal connecting traces connecting the first pads and the second pads.

3. The electrical connector as claimed in claim 1, wherein each first pad is soldered and covered by a rectangular metal block.

4. The electrical connector as claimed in claim 1, wherein the tail sections of the contacts and the second pads are arranged either in a single row or in upper and lower rows of the connecting member and the fixing member.

5. The electrical connector as claimed in claim 4, wherein when the tail sections of the contacts and the second pads are arranged in the single row and are coplanar with each other, the tail sections are exposed on a first mounting surface of the fixing member, the second pads are exposed on a second mounting surface of the connecting member, and the connecting member defines at least one position slot to receive corresponding tail sections of the contacts.

6. The electrical connector as claimed in claim 1, wherein the insulative housing comprises a base portion from which the mating portion forwardly extends along the extending direction, the mating portion defining a front end surface, the base portion defining a rear end surface, the receiving slot extending through the front end surface and the rear end surface, the connecting member being inserted into the receiving slot along a rear-to-front direction and stopped by the base portion.

7. The electrical connector as claimed in claim 6, wherein the base portion defines a pair of slits in communication with the receiving slot, the fixing member comprising a pair of protrusions inserted in the slits along a top-to-bottom direction, the fixing member pressing against the connecting member for position restriction.

8. The electrical connector as claimed in claim 1, wherein the connecting member defines at least one depression for deformation of the resilient arms when the electrical connector mates with the complementary connector.

9. The electrical connector as claimed in claim 1, wherein the contacts do not contact the connecting member.

10. The electrical connector as claimed in claim 1, wherein the electrical connector is a receptacle connector and comprises a metal shell enclosing the insulative housing and the fixing member, the metal shell comprising at least one engaging arm extending towards the mating portion for abutting against the complementary connector.

11. An electrical connector comprising:

an insulative housing comprising a mating portion and a receiving slot at least partly extending to the mating portion;

a plurality of contacts each comprising a tail section and a resilient arm, each resilient arm comprising a contacting section extending beyond the mating portion;

a fixing member retaining the contacts and fixed to the insulative housing, the fixing member comprising a first flat platform extending backwardly beyond a rear end of the electrical connector, the tail sections being arranged on the first flat platform; and a connecting member received in the receiving slot of the insulative housing, the connecting member comprising a plurality of first pads and a plurality of second pads electrically connecting with the first pads, the contacting sections and the first pads being arranged on the mating portion, the connecting member comprising a second flat platform extending backwardly beyond the rear end of the electrical connector, the second pads being arranged on the second flat platform; wherein the first flat platform and the second flat platform are cooperated with each other to jointly form a soldering platform for soldering the tail sections and the second pads.

12. The electrical connector as claimed in claim 11, wherein the first flat platform and the second flat platform are stacked with each other, the first flat platform comprising a first mounting surface, the second flat platform comprising a second mounting surface opposite to the first mounting surface, the tail sections and the second pads being exposed on the first mounting surface and the second mounting surface, respectively.

13. The electrical connector as claimed in claim 11, wherein the first flat platform and the second flat platform are interweaved with each other so as to form a single row, the tail sections of the contacts and the second pads being aligned in the single row.

14. The electrical connector as claimed in claim 13, wherein the insulative housing comprises a third flat platform to upwardly support the first flat platform and the second flat platform, each of the second flat platform and the third flat platform defining a position slot in alignment with each other along a vertical direction, the first flat platform being at least partly received in the position slots.

15. The electrical connector as claimed in claim 11, wherein the insulative housing comprises a base portion from which the mating portion forwardly extends, the mating portion defining a front end surface, the base portion defining a rear end surface, the receiving slot extending through the front end surface and the rear end surface, the second flat platform being stopped by the base portion to avoid over-insertion when the connecting member is inserted into the receiving slot along a rear-to-front direction.

16. The electrical connector as claimed in claim 15, wherein the base portion defines a pair of slits in communication with the receiving slot, the fixing member comprising a pair of protrusions inserted in the slits along a top-to-bottom direction of the mating portion for fixation, the fixing member pressing against the connecting member for position restriction.

17. The electrical connector as claimed in claim 11, wherein each contact comprises a middle section connecting the tail section and the resilient arm, the middle sections of the contacts being insert-molded with the fixing member.

18. The electrical connector as claimed in claim 11, wherein the connecting member defines at least one depression for deformation of the resilient arms when the electrical connector mates with a complementary connector.

19. The electrical connector as claimed in claim 11, wherein each first pad is soldered and covered by a rectangular metal block, and the contacts do not contact the connecting member.

20. The electrical connector as claimed in claim 11, wherein the electrical connector is compatible to Universal Serial Bus (USB) 3.0 type-A standard and is either a receptacle connector or a plug connector.

* * * * *